US005481807A

United States Patent [19]

Ploot

[11] Patent Number: 5,481,807

[45] Date of Patent: Jan. 9, 1996

[54] ARCHERY BOW SIGHT AND ADJUSTING TOOL

[75] Inventor: Terry Ploot, Hastings, Mich.

[73] Assignee: Pro Line Company, Hastings, Mich.

[21] Appl. No.: 212,955

[22] Filed: Mar. 15, 1994

[51] Int. Cl.[6] ..... F41G 1/467

[52] U.S. Cl. ..... 33/265; 124/87

[58] Field of Search ..... 33/265, 252, 254, 33/257, 258; 124/87; 81/176.15, 176.2, 125.1

[56] References Cited

U.S. PATENT DOCUMENTS

| | | | |
|---|---|---|---|
| 1,281,438 | 10/1918 | Tuttle | 81/125.1 X |
| 1,397,876 | 11/1921 | Meldal | 81/176.15 X |
| 2,900,973 | 8/1959 | Diehr | 33/265 X |
| 3,564,949 | 2/1971 | Hedrick | 81/176.15 |
| 3,760,659 | 9/1973 | Campbell . | |
| 3,822,616 | 7/1974 | Phillips . | |
| 4,026,032 | 5/1977 | Smith | 33/265 |
| 4,125,913 | 11/1978 | Lewis | 81/125.1 X |
| 4,449,303 | 5/1984 | Larson | 33/265 |
| 4,462,163 | 7/1984 | Tentler et al. | 33/265 |
| 4,875,290 | 10/1989 | Finch | 33/265 |
| 5,048,379 | 9/1991 | Gramera et al. | 81/125.1 X |
| 5,269,208 | 12/1993 | Kolvites et al. | 81/176.2 |

OTHER PUBLICATIONS

Proline Bow Sights and Accessories Brochure, 1993, Form No. DPL S4593 (no month).

1993 Browning Archery Products Catalog, pp. 32–33 (no month).

*Primary Examiner*—Thomas B. Will

*Attorney, Agent, or Firm*—Varnum, Riddering, Schmidt & Howlett

[57] ABSTRACT

An archery bow sight assembly comprises a mounting plate adapted for attachment to an archery bow and having an aperture therethrough. A sight pin extends through the aperture and a locking collar on the sight pin is rotatable toward and away from a locking position where the locking collar abuts the mounting plate or structure connected thereto to lock the sight pin within the aperture. The locking collar has an outer edge with at least one notch. A tool is provided for rotating the locking collar and comprises an elongated body having at least one projection extending from the body. The projection is adapted to be received within the notch so that when the tool is directed over the locking collar with the projection received within the notch, the tool can be manually rotated to rotate the locking collar.

13 Claims, 6 Drawing Sheets

ARCHERY BOW SIGHT AND ADJUSTING TOOL

BACKGROUND OF THE INVENTION

1. Field of the Invention

The present invention relates to an improved archery bow sight apparatus.

2. State of the Prior Art

To increase the accuracy of their shooting, many archery enthusiasts employ a sighting mechanism, similar to sights found on firearms. A typical archery bow sight comprises a vertically oriented plate having vertically elongated apertures and horizontally oriented sighting pins adjustably received within the apertures. The plate attaches to the handle of an archery bow slightly above the position where the arrow rests, and is typically cantilevered forwardly of the bow handle a short distance and oriented so that the sighting pins protrude into the archer's line of sight. Multiple sighting pins are typically employed, and each sighting pin typically comprises an elongated threaded body terminating in a steep conical section with a small sighting ball at its tip. The sighting balls for different sighting pins can be painted to represent different shooting ranges with different colors.

The sighting pins mount to the plate by means of a nut on one side of the plate through which the sighting pin is threaded and a locking collar threaded over the sighting pin on the opposite side of the plate. This mounting arrangement provides both windage and elevation adjustment for each sighting pin. Windage is adjusted by threading the sighting pin horizontally through the locking nut. Elevation is adjusted by moving the sighting pin vertically within the elongated apertures in the plate.

To provide accurate elevation correction for targets at a variety of distances from the archer, many archers prefer to have a multitude of sighting pins mounted to the plate. To alleviate the vertical crowding of the sighting pins, many plates have two or more parallel vertically oriented apertures for receiving the sighting pins. Sometimes the sighting pins are vertically spaced apart only a short distance. For instance, when attempting to provide individual sighting pins for targets at several close ranges, such as 15, 20 and 25 yards, the sighting pins for each of those ranges would be located quite close to each other vertically. Also, when shooting high velocity bows which produce flatter trajectories, less correction for elevation is necessary, also causing the sighting pins to be located more closely together.

When the pins are located close to one another, it can be difficult for a user to adjust an individual pin as the proximity of adjacent pins may prevent a user's fingers from reaching the locking collar on the desired sighting pin. Some archers carry needlenose pliers for reaching into the tight space between adjacent pins. However, even with needlenose pliers, it can be difficult to adjust the locking collar on a sighting pin.

SUMMARY OF THE INVENTION

The archery bow sight assembly according to the present invention overcomes these limitations by providing an elongated tool for reaching between adjacent sighting pins and firmly grasping a locking collar for rotation thereof.

An archery bow sight assembly according to the invention comprises a mounting plate adapted for attachment to an archery bow. The sight assembly has at least one aperture therethrough. The aperture can be, but is not necessarily, elongated. A sight pin extends through the aperture and a locking collar on the sight pin is rotatable toward and away from a locking position. In the locking position, the locking collar abuts the mounting plate or other structure connected to it in order to lock the sight pin within the aperture. The locking collar has an outer edge with at least one notch. A tool for rotating the locking collar comprises an elongated body having at least one projection extending from the body. The projection is adapted to be received within the notch so that when the tool is directed over the locking collar with the projection received within the notch, the tool can be manually rotated to rotate the locking collar.

In one aspect of the invention, the archery bow sight comprises threads on the sight pin with the locking collar threadably receiving the sight pin and a bore is provided in the tool for receiving the sight pin. Preferably, the tool is cylindrical and a bore extends axially into the cylinder, thereby defining an annular edge surrounding the bore. The projection extends axially from the annular edge of the tool.

Also, the sight pin can be threadably received within the aperture. In this case, the mounting plate has a first face and an opposing second face, with the aperture being vertically elongated. The mounting plate has a threaded nut abutting the first face and threadably receiving the sight pin whereby an elevation of the sight can be adjusted by vertical movement of the sight pin within the aperture.

The threaded nut can further comprise an abutting portion abutting the first face and a barrel portion extending through the aperture, with the barrel portion having a threaded outer surface and a threaded bore therethrough. The sight pin is threadably received within the threaded bore and a second locking collar is threadably received upon the threaded outer surface adjacent the second face for locking the position of the threaded nut within the aperture. The second locking collar has an outer edge with at least one second notch; and the tool further comprises a second bore for receiving the first locking collar and at least one second projection extending from the body adjacent the second bore. The second projection is adapted to be received within the second notch on the second locking collar. Preferably, the tool further comprises a knurled annular ring about the tool body so that a user can more easily grip the tool.

In another aspect of the invention, a method for adjusting a sight pin in an archery bow sight comprises the steps of: providing a mounting plate with an elongated aperture for receiving the sight pin; providing a first rotatable locking collar on the sight pin for locking the position of the sight pin within the mounting plate elongated aperture; providing a first surface on the locking collar and a tool having a mating second surface; mating the first and second surfaces and unlocking the locking collar by manually rotating the tool; adjusting the position of the sight pin within the elongated aperture; and locking the locking collar by manually rotating the tool.

BRIEF DESCRIPTION OF THE DRAWINGS

The invention will now be described with reference to the accompanying drawings in which.

DETAILED DESCRIPTION

Figure 1:
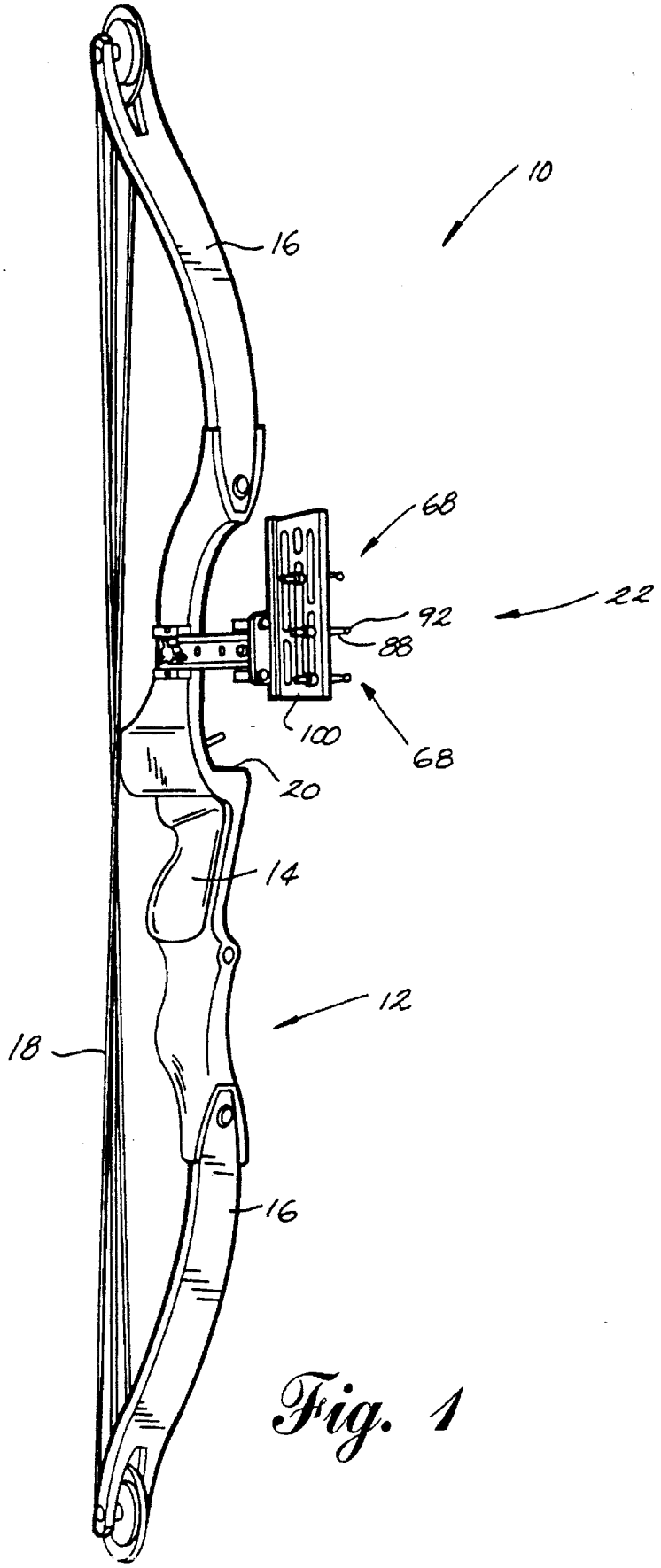
FIG. 1 illustrates a perspective view of a bow having a bow sight according to the invention.

As shown generally in FIG. 1, an archery bow 10 comprises a center section 12 having a handle portion 14 with limbs 16 extending outwardly therefrom. A bow string 18 extends between outer end portions of the limbs 16. An arrow rest 20 is disposed on the central section 12 above the handle 14. A sighting assembly 22 according to the invention mounts to the central section 12 above the arrow rest 20, and extends forwardly therefrom.

Figure 2:
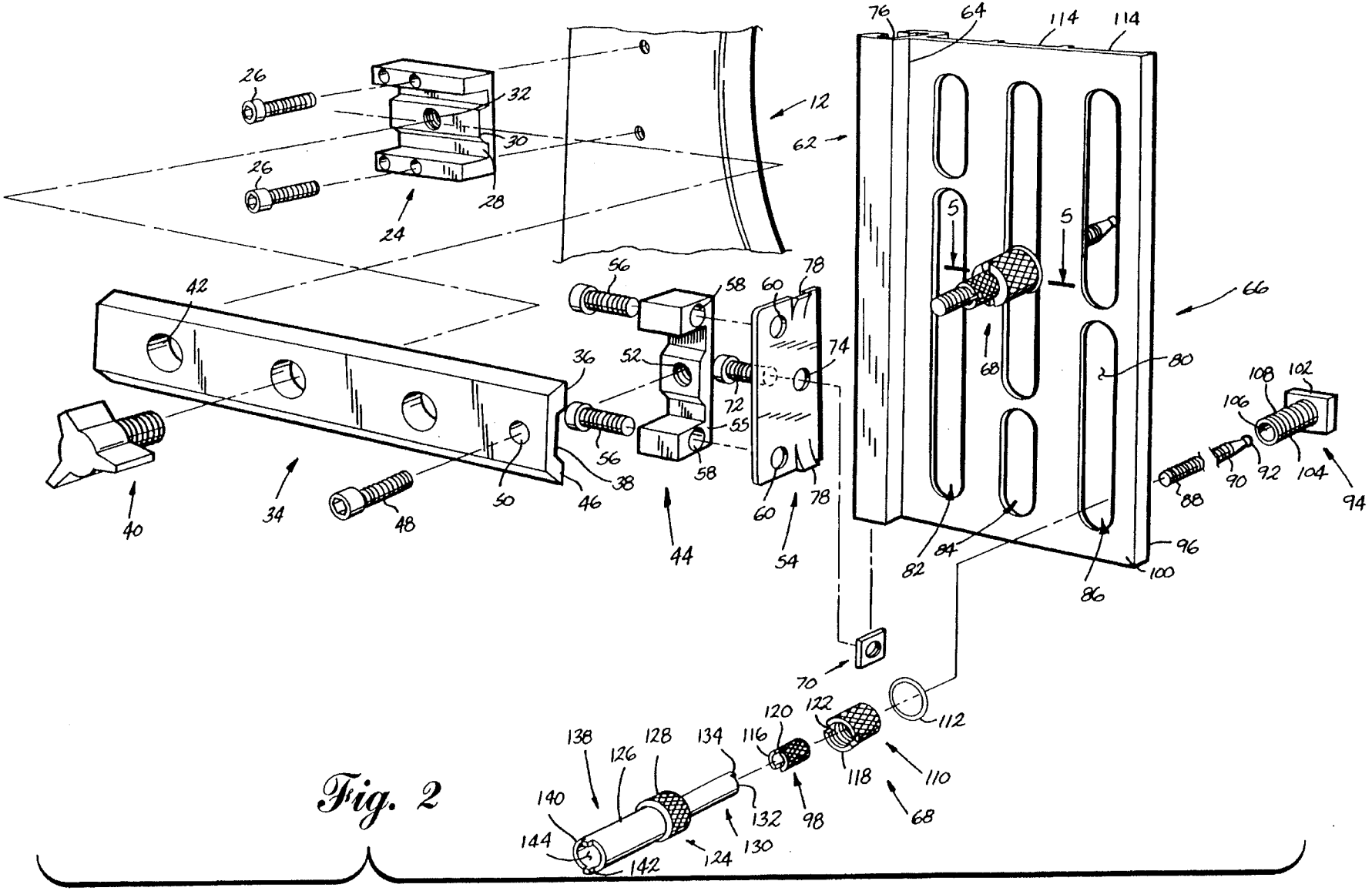
FIG. 2 is an exploded view of the bow sight of FIG. 1 and a tool according to the invention for adjusting the bow sight.
Figure 3:
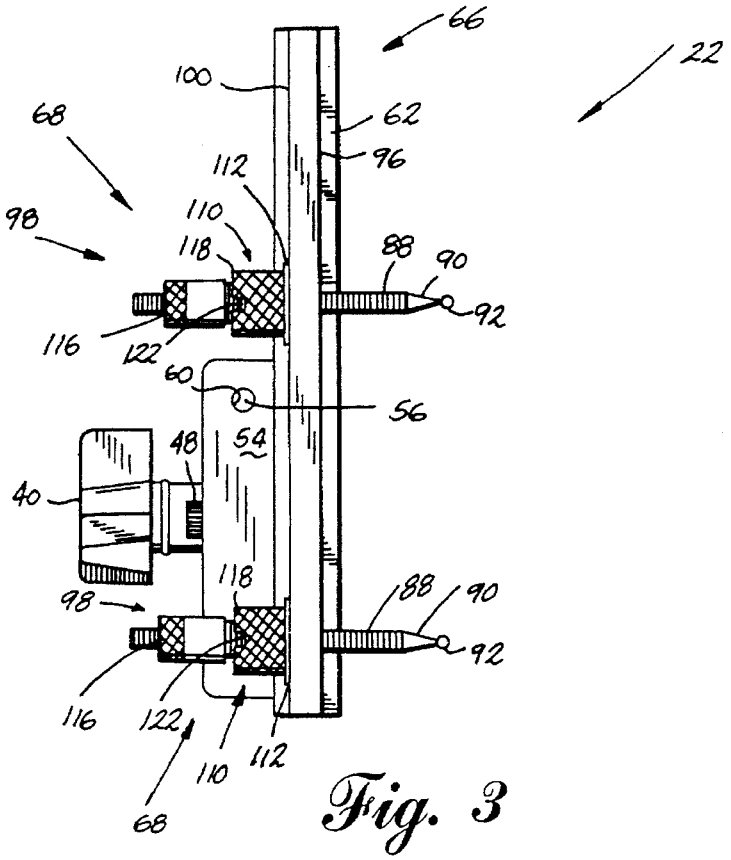
FIG. 3 is a front elevational view of the bow sight of FIG. 2.
Figure 4:
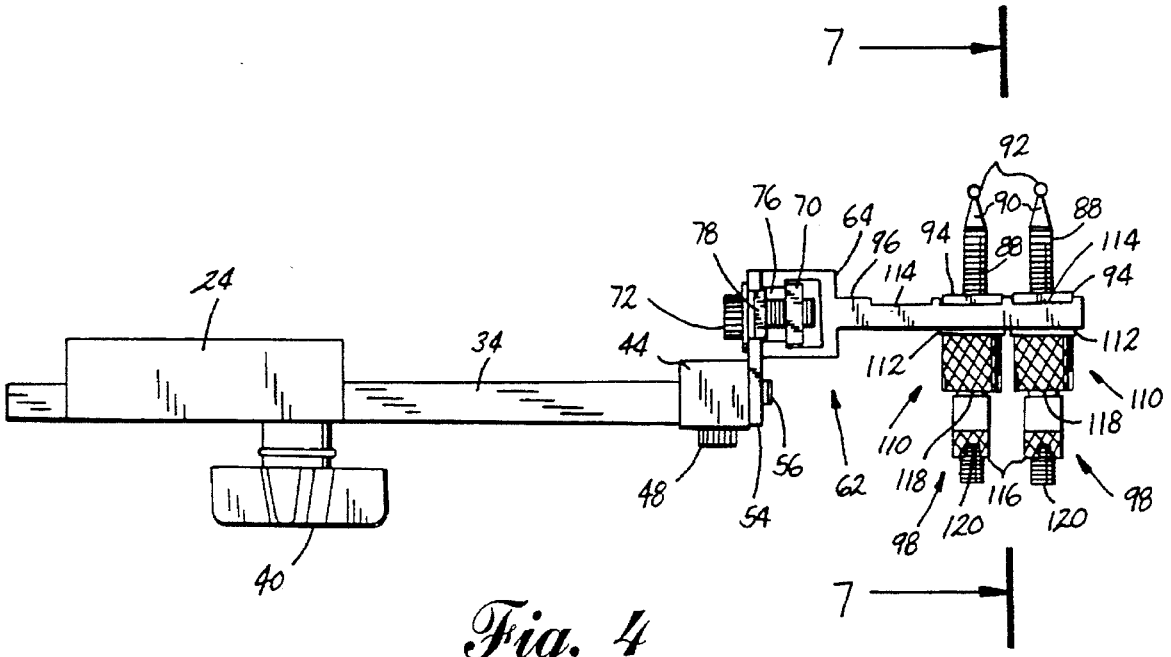
FIG. 4 is a top plan view of the bow sight of FIG. 2.

Turning primarily to FIG. 2, and with further illustration provided by FIGS. 3 and 4, a mounting block 24 attaches to the bow central section 12 by means of screws 26 passing through the mounting block 24 and threaded into the bow central section 12. The mounting block 24 is generally U-shaped in cross-section forming a channel 28 which extends horizontally across the mounting block 24 away from the bow central section 12. A guide rib 30 on the mounting block 24 passes through the bottom of the mounting block channel 28 and has a truncated isosceles triangle cross-sectional shape. A threaded aperture 32 passes horizontally through the guide rib 30 and mounting block 24.

An extension arm 34 is received within the mounting block channel 28 and extends horizontally forwardly therefrom. A rear side 36 of the extension arm 34 has a longitudinally extending trough 38 of a complementary shape to the guide fib 30 for a positive engagement with the mounting block 24. A thumb screw 40 passes through a selected one of a plurality of apertures 42 passing horizontally through the extension arm 34 and is received within the threaded aperture 32 on the mounting block 24 for adjustably fixing the longitudinal position of the extension arm 34 within the mounting block channel 28.

An auxiliary block 44 having a similar cross-sectional shape to the mounting block 24 affixes to a forward end 46 of the extension arm 34 by means of a screw 48 passing through an aperture 50 in the extension arm and received within a threaded aperture 52 in the auxiliary plate 44. A tracking plate 54 affixes to a forward face 55 of the auxiliary block 44 by means of screws 56 passing horizontally forwardly through apertures 58 in the auxiliary block 44 and threadably received within threaded apertures 60 in the tracking plate 54. The tracking plate 54 engages a C-shaped channel 62 along a rearward edge 64 of a vertically disposed mounting plate 66 adapted to receive a plurality of sight pin assemblies 68 therein.

To hold the mounting plate 66 to the tracking plate 54, a square jam nut 70 is closely received within the C-shaped channel 62 and a screw 72 passes through an aperture 74 in the tracking plate 54, through a rearwardly facing opening 76 into the C-shaped channel 62 and is threadably received within the jam nut 70. A pair of guide fingers 78 extend forwardly from top and bottom portions of the tracking plate 54 and are formed by bending a portion of the material of the tracking plate 54 forwardly. The guide fingers 78 are snugly received within the C-channel opening 76 to provide lateral stability for the mounting plate 66 upon the tracking plate 54.

It will be understood, of course, that any number of arrangements can be provided for adjustably mounting the mounting plate 66 to the bow central section 12. However, the mounting arrangement illustrated and described herein provides particular flexibility in positioning the mounting plate. For instance, the plurality of apertures 42 in the extension arm 34 provides a number of discrete forward and rearward positions for the mounting plate 66. Also, vertical adjustment of the mounting plate is possible by sliding the mounting plate 66 relative to the tracking plate 54 and tightening the screw 72. For a positive and sure engagement provided with a lightweight tool, the various screws 26, 48, 56 and 72 can be of the hexhead type for receipt of a hex driver (not shown), often termed an Allen wrench.

The mounting plate 66 is provided with a plurality of elongated vertical apertures 80 arranged in parallel rearward, central and forward rows 82, 84 and 86. Each of the rows 82, 84 and 86 can comprise a single elongated aperture. However, the arrangement illustrated with multiple apertures 80 in each of the rows 82, 84 and 86 provides additional rigidity to the mounting plate 66 while maintaining flexibility in positioning the sight pin assemblies 68.

Each sight pin assembly 68 comprises an elongated threaded sight pin 88 having a steep conical section 90 terminating in a spherical ball 92 at one end thereof. Each of the sight pins 88 is held within one of the elongated apertures 80 by means of a threaded nut 94 adjacent a mounting plate inner face 96 (facing towards the bow 10 and into the archer's line of sight) and a first locking collar 98 adjacent a mounting plate outer face 100 (facing away from the bow 10). Most prior sight pins employ a common nut for the threaded nut 94 and the sight pin 88 is held in place by abutment of the locking collar 98 against the mounting plate outer face 100 and abutment of the threaded nut 94 against the mounting plate inner face 96. Horizontal adjustment of the sighting pin 88 relative to the mounting plate 66 in such a design is accomplished by unlocking the locking collar 98 and threading the sighting pin 88 through the threaded nut 94 and relocking the locking collar 98 when the sighting pin 88 is in the desired position. However, this has the distinct disadvantage of releasing the vertical position of the sight pin 88 within the elongated aperture 80 at the same time.

The arrangement of the present invention provides individual adjustment for windage and elevation (horizontal and vertical movement of the sight pin 88) independent of one another. The threaded nut 94 comprises an abutting portion 102 dimensioned to not pass through the elongated apertures 80, and a barrel portion 104 extending from the abutting portion through the elongated aperture 80. A threaded bore 106 passes coaxially through the barrel 104 and abutting portion, 102 for threadably receiving the sight pin 88. An outer surface 108 of the barrel portion 104 is threaded and threadably receives a second locking collar 110. A washer 112 can be provided between the second locking collar 110 and the mounting plate outer surface 100. The threaded nut abutting portion 102 is square and snugly fits within one of a series of shallow channels 114 on the mounting plate inner face 96 in alignment with the elongated apertures 80. Engagement between the abutting portion 102 and the channels 114 prevent rotation of the threaded nut 94 for easier threading of the second locking collar 110. The second locking collar 110 thus controls vertical orientation of the sight pin 88 within one of the elongated apertures 80. In other words, the second locking collar 110 adjusts the elevation for a particular sight pin 88. The first locking collar 98 fixes the horizontal position of the sight pin 88, thereby adjusting the windage of the sight pin 88, by abutting the barrel portion 104 of the threaded nut 94.

Each of the first and second locking collars 98 and 110 have an outer annular edge 116 and 118, respectively. A pair of notches 120 and 122, spaced 180° apart, extend axially into each of the first and second locking collars 98 and 110 through their respective annular edges 116 and 118. A tool 124 adapted to engage the notches 120 and 122 on the first and second locking collars 98 and 110 is provided for selectively releasing and engaging the first and second locking collars 98 and 110.

Figure 5:
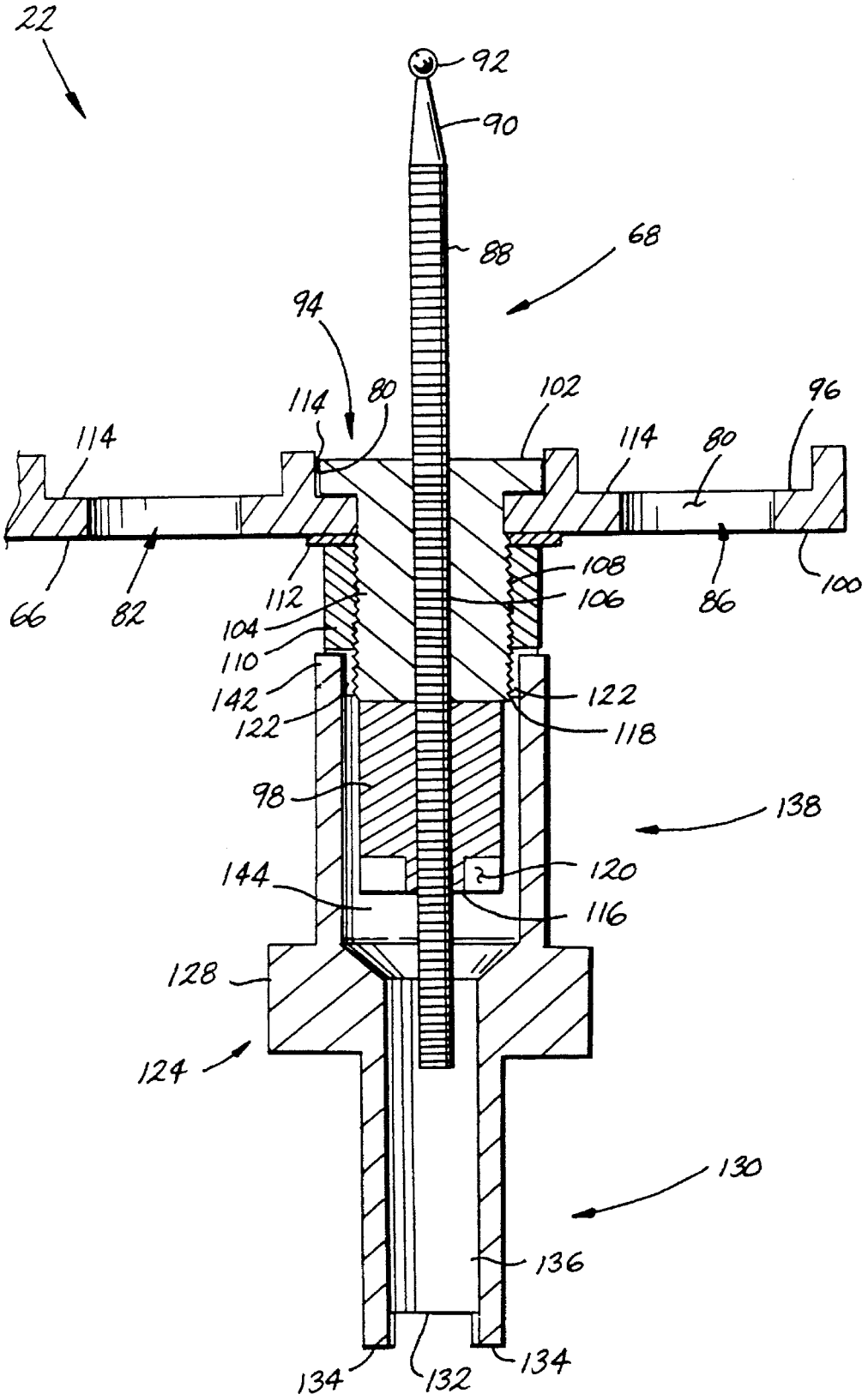
FIG. 5 is a sectional view of a bow sight pin taken along line 5—5 of FIG. 2.

As best seen in FIGS. 2 and 5, the tool 124 comprises an elongated cylindrical body 126 having a central knurled annular flange 128. A first end of the tool 130 has a diameter equal to the diameter of the first locking collar 98 and terminates in a first annular end 132. A pair of projections 134 extend axially from the first annular edge whereby the tool first end 130 has a complementary shape to the first locking collar 98 such that the tool first annular edge 132 may be placed into abutment with the first locking collar annular edge 116 with the projections 134 received within the first locking collar notches 120. A first coaxial bore 136 extends coaxially into the tool first end 130 so that the tool may be fitted over the sight pin 88 to engage the first locking collar 98. When the tool 124 and first locking collar 98 are so engaged, the tool may be used to rotate the locking collar.

A second end of the tool 138 has a similar configuration to the tool first end 130, having a second annular edge 140, projections 142 extending axially therefrom and a second coaxial bore 144 extending into the tool second end 138 to meet the first coaxial bore 136. The second coaxial bore 144 is sized to fit over the first locking collar 98 so that the tool second end 138 can engage the second locking collar 110 in similar fashion to the engagement between the tool first end 130 and first locking collar 98. Accordingly, the overall diameter of the tool second end 138 is larger than the tool first end 130.

In use, an archer can arrange a suitable number of sight pin assemblies 68 within the elongated apertures 80 on the mounting plate 66 for a particular style of shooting that the archer prefers. For instance, if the archer is shooting at targets at known, discrete, yet close ranges, the archer may put a sight pin assembly 68 into the mounting plate 66 for each range of targets. If as described, the target's ranges are close together, the sight pins 88 must necessarily be positioned in a relative tight vertical grouping. Additionally, if the sight assembly 22 is mounted to a high velocity bow, the trajectory of the arrows will be relatively flat, thus further reducing the vertical spacing between the sight pins 88. The three rows 82, 84, 86 of elongated apertures 80 allows the archer to vertically space adjacent sight pins 88 more closely than a single elongated aperture 80.

To vertically adjust an individual sight pin assembly 68, an archer first loosens the second locking collar 110 to permit the threaded nut 94 to slide vertically within the elongated aperture 80. The archer then repositions the sight pin assembly 68 and tightens the second locking collar 110 to fix the vertical position of the sight pin assembly 68 within the elongated aperture 80. Both the first and second locking collars 98, 110 are provided with knurled outer surfaces to aid in finger tightening and loosening thereof. However, the tool 124 is preferably used to assist the rotation of the locking collars 98, 110. To adjust the windage for an individual sight pin assembly 68, the user loosens the first locking collar 98 and threads the sight pin 88 through the threaded nut 94 to horizontally adjust the position of the sight ball 92. When the desired position is achieved, the user merely retightens the first locking collar 98.

Figure 6:
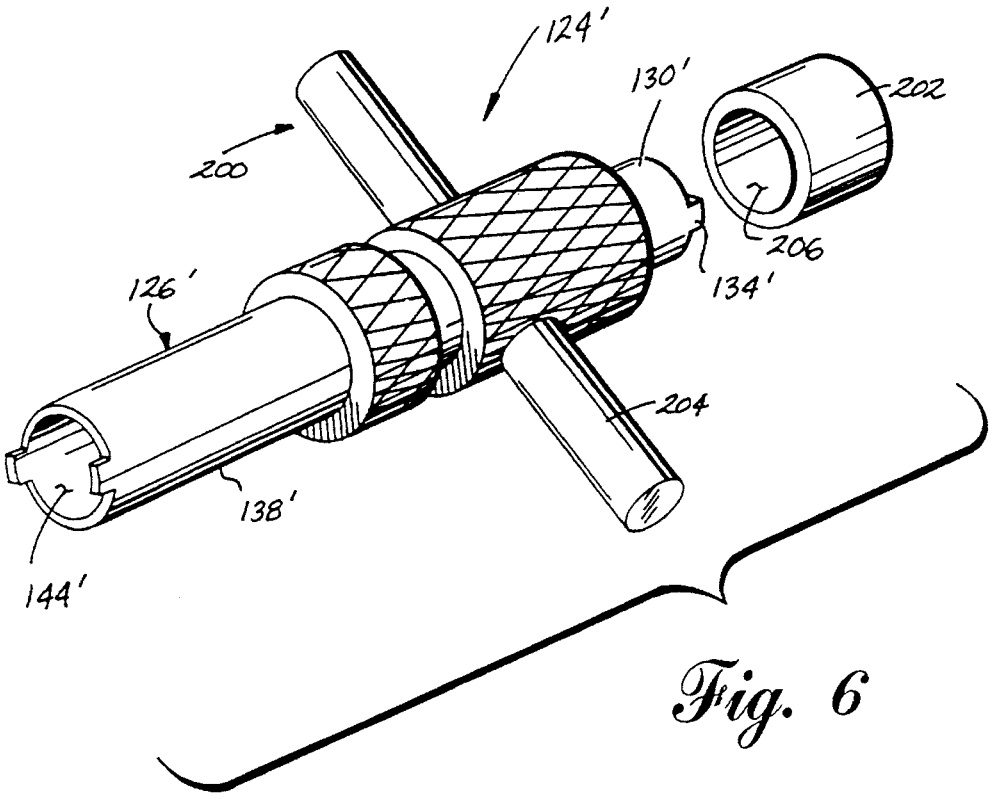
FIG. 6 is a perspective view of an alternative embodiment of a tool according to the invention for adjusting the bow sight.
Figure 7:
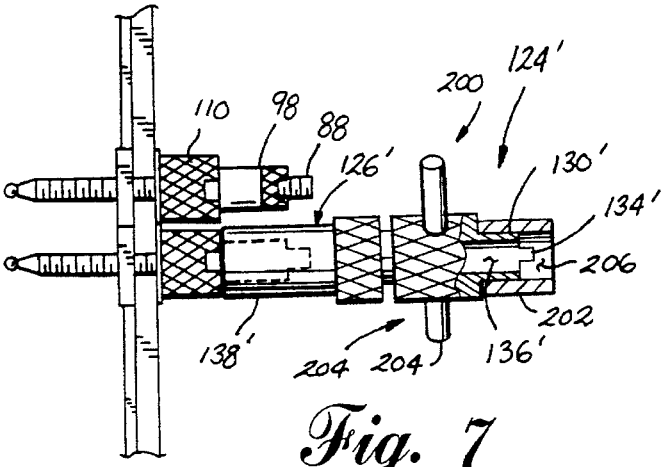
FIG. 7 is a rear sectional view taken along line 7—7 of FIG. 4, where two sight pins of the bow sight are rearranged vertically adjacent one another and one of the sight pins is engaged by a first end of the tool of FIG. 6.
Figure 8:
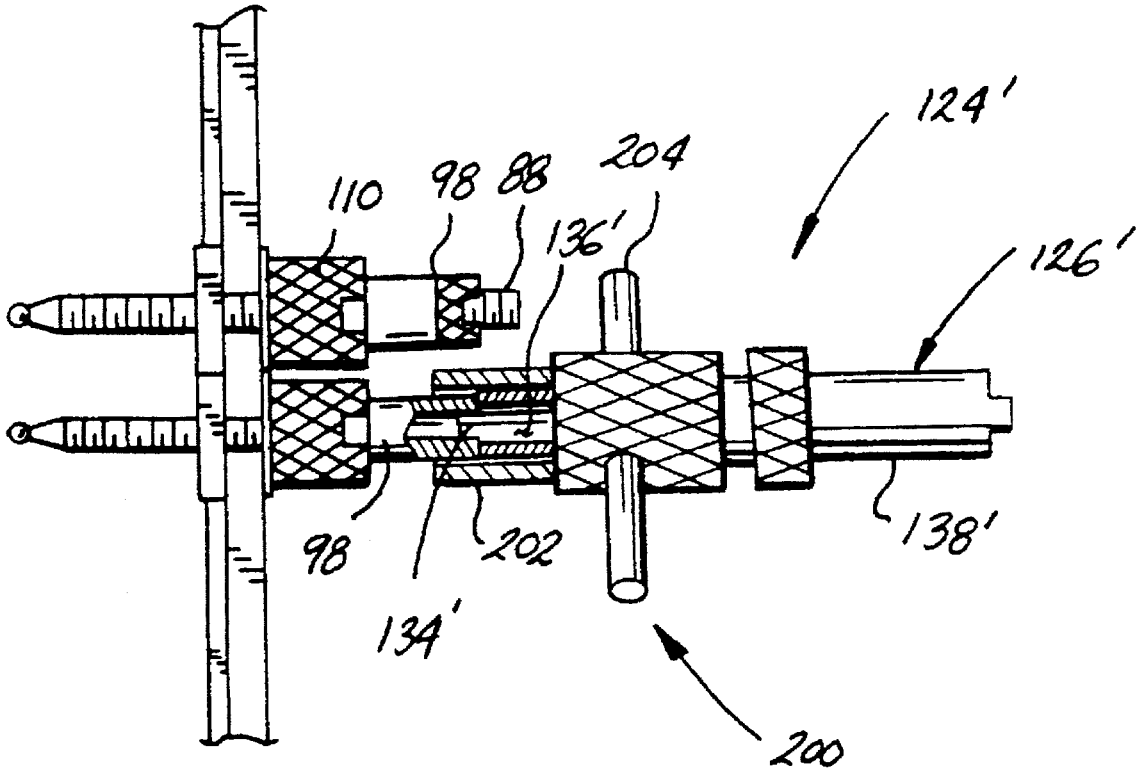
FIG. 8 is a rear sectional view of the bow sight of FIG. 7 with one of the sight pins engaged by a second end of the tool of FIG. 6.

FIGS. 6, 7, and 8 illustrate an alternative embodiment of a tool 124', wherein like parts are illustrated with like reference numerals designated with a prime symbol. The tool 124' is similar in nearly all respects to the tool 124 of the previous embodiment, but contains the additional features of a cross bar 200 and a locating collar 202. The cross bar 200 extends perpendicularly through the tool body 126' and provides an additional gripping surface 204 whereby a user may more easily rotate a recalcitrant locking collar 98 or 110. Preferably, the cross bar 200 comprises a solid cylindrical rod, but may comprise any form of protuberance which extends outwardly of the tool body 126' to enhance a user's grip thereof. For instance, the cross bar need not comprise a single bar protruding through the first or second coaxial bores 136' and 144' and may take a more ergonomically designed shape. If the cross bar 200 is positioned to pass through the one of the coaxial bores 136' or 144', it is desireable to extend the length of the tool second end 138' to reduce the possibility of interference between the cross bar 200 and the sight pin 88 (See FIG. 7).

The locating collar 202 has a cylindrical shape with a central coaxial bore 206 adapted to receive the tool first end 130' with an interference fit or other suitable means of attachment. The collar 202 extends axially beyond the projections 134' at the tool first end 130'. As shown in FIG. 8, the collar central bore 206 loosely receives the first locking collar 98 to guide the projections 134' into proper engagement with the notches 120 on the first locking collar 98.

While particular embodiments of the invention have been shown, it will be understood that the invention is not limited thereto since modification can be made by those skilled in the art, particularly in light of the foregoing teachings. For instance, many types of mounting arrangements are commonly provided for fixing sight pins 88 to plates 66, and it will be appreciated that the principles of the present invention are not limited to the sight pin assemblies herein disclosed. Also, it will be understood that notches can be provided on the tool and pins upon the locking collars to achieve the same effect as disclosed with pins or the tool and notches on the locking collar. In fact, any complementary shapes which will permit the tool to manipulate the locking collars may be provided upon the tool ends and locking collar outer surfaces. Reasonable variation and modification are possible within the foregoing disclosure of the invention without departing from its true spirit and scope. While the invention has been particularly described in connection with a specific embodiment thereof, it is to be understood that this is by way of illustration and not limitation, and the scope of the appended claims should be construed as broadly as the prior art will permit.

The embodiments of the invention in which an exclusive property right or privilege is claimed are defined as follows:

1. In an archery bow sight assembly comprising:

a mounting plate adapted for attachment to an archery bow and having at least one slot therein;

at least one sight pin adapted to mount to the mounting plate and to extend through the at least one slot, said sight pin having a first locking collar to lock the sight pin to the plate against lateral movement within the slot and a second locking collar to lock the sight pin against longitudinal movement through the slot, one of the first and second locking collars having a diameter less than the other, the improvement comprising:

each of the first and second locking collars having at least one discontinuity on an annular edge thereof, and a tool comprising an elongated body having a cavity open at one end and partially bounded by a first annular edge with a discontinuity complementary in shape to the discontinuity on one of the first and second locking collars, the cavity being dimensioned to receive the smaller of the first and second locking collars in telescoping relationship, the body also having a second annular edge with a discontinuity complementary in shape to the discontinuity on the other of the first and second locking collars, whereby the tool can be used to selectively tighten or loosen the first and second locking collars, even when multiple sight pins are located closely adjacent to one another.

2. An archery bow sight assembly according to claim 1 wherein the at least one sight pin has threads and the first and second locking collars threadably, coaxially receive the sight pin.

3. An archery bow sight assembly according to claim 1 wherein the tool body is generally cylindrical, and the cavity extends coaxially into the cylindrical open end.

4. An archery bow sight assembly according to claim 1 wherein the tool further comprises a grip handle extending radially outwardly from the tool body.

5. An archery bow sight assembly according to claim 1 wherein the discontinuity on each of the first and second locking collars is at least one notch.

6. An archery bow sight assembly according to claim 5 wherein the first and second locking collars each have two notches.

7. An archery bow sight assembly according to claim 6 wherein the notches are 180° apart.

8. An archery bow sight assembly according to claim 1 wherein the discontinuity on each of the first and second annular edges is at least one projection.

9. An archery bow sight assembly according to claim 8 wherein the first and second annular edges each have two projections.

10. An archery bow sight assembly according to claim 9 wherein the projections are 180° apart.

11. An archery bow sight assembly according to claim 1 wherein the first and second annular edges of the tool face in opposite directions.

12. An archery bow sight assembly according to claim 11 wherein the second annular edge is recessed.

13. An archery bow sight assembly according to claim 1 wherein the second annular edge is recessed.

* * * * *